United States Patent [19]

Pratt

[11] 4,043,811

[45] Aug. 23, 1977

[54] CONVERSION SOLUTIONS FOR PLANOGRAPHIC MASTERS

[75] Inventor: Richard John Pratt, Solon, Ohio

[73] Assignee: Addressograph Multigraph Corporation, Cleveland, Ohio

[21] Appl. No.: 709,667

[22] Filed: July 29, 1976

[51] Int. Cl.[2] ..... G03G 13/28

[52] U.S. Cl. ..... 96/1 R; 96/33; 106/2; 101/465

[58] Field of Search ..... 106/2; 101/465, 466, 101/451; 96/33, 1 R, 1.8

[56] References Cited

U.S. PATENT DOCUMENTS

| | | | |
|---|---|---|---|
| 3,211,686 | 10/1965 | Uber et al. | 101/451 |
| 3,573,041 | 3/1971 | Van Engeland | 96/33 |
| 3,661,598 | 5/1972 | Rosenberger | 101/451 |
| 3,672,885 | 6/1972 | Ort | 96/33 |
| 3,714,891 | 2/1973 | VanDusen et al. | 101/465 |
| 3,726,823 | 4/1973 | Morishima et al. | 101/451 |
| 3,891,439 | 6/1975 | Katz et al. | 101/465 |
| 3,970,455 | 7/1976 | Nadeau et al. | 101/451 |

*Primary Examiner*—J. Travis Brown
*Attorney, Agent, or Firm*—Sol L. Goldstein

[57] ABSTRACT

A conversion solution for rendering hydrophilic the zinc oxide resin binder type planographic masters containing 2.0% potassium ferrocyanide, phosphoric acid to produce a pH in the range of 4.1 - 4.2 and a buffering salt of ammonium acid phosphate or sodium acid phosphate to buffer the solution and 4.0% by weight of triethanolamine as a modifying and solvating agent to raise the solubility threshold preventing formation of needle-like crystals that tend to form as water evaporates from the solution, and modify the physical property of crystals that do form to a less-hard structure.

12 Claims, No Drawings

CONVERSION SOLUTIONS FOR PLANOGRAPHIC MASTERS

BACKGROUND OF THE INVENTION

This invention relates generally to ferrocyanide type conversion solutions, and, more particularly, to compositions containing organic amine additives for solvating salt crystals which form in such solutions during usage.

The use of conversion solutions of the type using a ferrocyanide is well known in the art. Improvements have been made in the composition of such conversion solutions, built around the ferrocyanide as the active ingredient, such as to prevent oxidation of the ferrous ions in the active ingredient to ferric ions. Further, the compositions have been modified to include chelating agents which sequester heavy metal ions, such as ferric ions, which may be present either by virtue of any impurities or due to the hydrolysis of the ferrocyanide to the ferro-ferrous ions thereby preventing discoloration of the solutions.

Notwithstanding the various improvements that have been made in this art, conversion solutions will suffer from certain deficiencies, particularly under conditions of continued usage in a duplicator environment wherein a certain amount of evaporation occurs in the aqueous system. Understandably, such evaporation may be considerable, thereby concentrating the various ingredients to as much as twice their original level. This results in the formation of various salt crystals. Such salt crystals are the reaction product of the ferrocyanide with phosphoric acid which must be present to maintain an acidic pH. The precipitation of such crystals endangers the various fragile surfaces to which the conversion solution must be applied. Hence, it is critical that the formation of any such salt crystals be avoided to protect the photoconductive printing surfaces.

SUMMARY OF THE INVENTION

In the typical conversion solution formulation, the active ingredient is potassium ferrocyanide. The solution requires an acidic environment in order to convert the conventional photoconductive layer containing zinc oxide dispersed in the resin binder to a hydrophilic surface in the non-image areas. It will be understood that other photoconductive materials which are equivalent to inorganic zinc oxide when dispersed in a resin binder respond to conversion solutions of this invention. In order to maintain this pH level in the solution, it is buffered with a salt of a strong base such as sodium acid phosphate. The type of salt used to buffer the system will be governed by the mineral acid employed.

The addition of the sodium acid phosphate salt under the concentration conditions present in a fresh solution serves to set up the proper conditions of buffering so that the solution withstands stresses to the equilibrium condition so as to resist change in pH.

Under conditions of use, evaporation of water occurs increasing the concentration of the acidifying agent as well as the buffering salt so that the equilibrium concentration necessary to keep the salt in solution is thrown out of balance. There must occur a precipitation of the salt as would be expected under known solubility equilibrium criteria for the system. In the circumstance there is an increase in concentration of one of the components of the equilibrium system, salt crystals precipitate. Typically, these crystals are very sharp, hard and needle-like. It is these sharp needle-like crystals that cause damage to the photoconductive planographic surface when converted.

To overcome this problem, it has been found that the addition of a solubilizing amine having the formula:

$$R\,R'\,N - C_n H_{2n} - O - X$$

where R and R′ are the same or different alkyl or hydroxy alkyl or amino alkyl substituents or are hydrogen, X is hydrogen, lower alkyl or lower hydroxy alkyl and *n* is an integer from 2 to 4, inclusive, tends to form a hygroscopic multi-hydrated salt crystal having the unique and surprising property of greater solubility and ultimately less damaging effect on the planographic surface on which the solution is to act by virtue of being a "softer crystal."

It is a general object of this invention to provide an improved conversion solution which has been properly acidified and treated with the necessary buffering salts to maintain a desired pH level and to stabilize the solution against the formation of abrasive salt crystals by the addition of a solvating agent.

It is a specific object of this invention to provide an improved conversion solution to which has been added a buffering salt, which solution is formulated so as to permit increased concentrations of the buffering salt so that the physical character of any salts formed in solution are not abrasive to the photoconductive surface.

It is a still further object of this invention to provide a conversion solution which has been acidified and treated with buffering salts to maintain a pH level within a given range of concentration and which solution has been formulated to include a solubilizing agent having hygroscopic properties so that as the solution undergoes evaporation of water, the critical threshold level at which crystal formation occurs is maintained at a higher level and the nature of any crystals that may be formed is inocuous in respect of the damaging effect they may have on the planographic surface.

DETAILED DESCRIPTION OF THE INVENTION

The active ingredient in a conversion solution is potassium ferrocyanide. It is present in amounts ranging from 0.5 to 5 percent by weight of solution and preferably an amount within the range of 1 to 2½ percent by weight. In order for the ferrocyanide to effectively convert the surface of the zinc oxide-resin binder photoconductive layer, the solution must be maintained at a pH in the range of 4.0 to 5.0 which can be achieved by the addition of a mineral acid such as phosphoric acid. As described earlier, such acidified solution will contain a buffering salt as monobasic ammonium phosphate or monobasic sodium phosphate so that the aqueous system will resist changes in pH.

To the solution is now added an organic amine having the formula:

$$R\,R'\,N - C_n H_{2n} - O - X$$

wherein R and R′ are the same or different alkyl or hydroxy alkyl or amino alkyl substituents or hydrogen, X is hydrogen, lower alkyl or lower hydroxy alkyl and *n* is an integer from 2 to 4, inclusive, in the range of from 1 percent to 6 percent by weight of the solution.

Representative of the amines coming within the above general formula having utility in the practice of this invention are the following:

2-(2-aminoethylamino) ethanol
2-amino-2-methyl-1-propanol
3-amino-1-propanol
2-[N,N bis (aminomethyl) amino] ethanol
2-diethylaminoethanol
3-diethylamino-1-propanol
2-dimethylaminoethanol
3-dimethylamino-1-propanol
2-ethylaminoethanol
2-methylaminoethanol
1-dimethylamino 1,propanol
monoethanolamine
2-amino-2-methyl-1,3-proponediol
tris hydroxymethyl-aminomethane The mechanism whereby the results are achieved in the improved stabilization of the conversion solution has not been definitely established. It is believed, however, that the addition of the amine tends to form a hygroscopic-multihydrated amine phosphate salt which tends to be more soluble at the lower concentrations of water and tends to form a softer crystal.

The following examples are intended to illustrate the range of formulations of conversion solutions believed to achieve the objectives set forth hereinabove and are not intended to limit the invention or the basic concepts set forth above. The amounts are all shown in percent by weight.

Example 1

| | % |
|---|---|
| Potassium Ferrocyanide ($K_4Fe(CN)_6 . 3H_2O$ | 2.0 |
| Monobasic ammonium Phosphate $NH_4H_2PO_4$ | 5.0 |
| Glycerine | 8.0 |
| Triethanolamine [(HO $CH_2$ $CH_2)_3$ - N] | 4.0 |
| Gum Arabic | 0.5 |
| Distilled Water | 80.5 |
| Phosphoric Acid to Adjust pH to | 4.1–4.2 |

Example II

| | |
|---|---|
| Potassium Ferrocyanide [$K_4Fe(CN)_6 . 3H_2O$] | 1.0 |
| Monobasic ammonium Phosphate $NH_4H_2PO_4$ | 5.0 |
| Glycerine | 8.0 |
| Diethanolamine [(HO $CH_2$ $CH_2)_2$ . NH] | 6.0 |
| Gum Arabic | 0.5 |
| Distilled $H_2O$ | 79.5 |
| Phosphoric Acid $H_3PO_4$ to Adjust pH | 4.1–4.2 |

Example III

| | |
|---|---|
| Potassium Ferrocyanide [$K_4Fe(CN)_6 . 3H_2O$] | 2.0 |
| Monobasic ammonium Phosphate $NH_4H_2PO_4$ | 5.0 |
| Glycerine | 8.0 |
| Monoethanolamine [HO $CH_2$ $CH_2$ $NH_2$] | 1.0 |
| Gum Arabic | .5 |
| Distilled $H_2O$ | 84.5 |
| Phosphoric Acid $H_3PO_4$ added to adjust pH | 4.1–4.2 |

Example IV

| | % |
|---|---|
| Potassium Ferrocyanide [$K_4Fe(CN)_6 . 3H_2O$] | 2.7 |
| Monobasic ammonium Phosphate $NH_4H_2PO_4$ | 2.0 |
| Glycerine | 5.5 |
| Triethanolamine | 4.0 |
| Gum Arabic | .5 |
| Distilled $H_2O$ | 85.3 |
| Phosphoric Acid $H_3PO_4$ added to adjust pH to | 4.1–4.2 |

Example V

| | |
|---|---|
| Potassium Ferrocyanide ($K_4Fe(CN)_6 . 3_2O$ | 2.7 |
| Monobasic ammonium Phosphate $NH_4H_2PO_4$ | 5.0 |
| Glycerine | 5.5 |
| 2-amino-2-methyl-1,3-propanediol | 4.0 |
| Gum Arabic | 0.5 |
| Distilled Water | 82.3 |

Example V-continued

| | |
|---|---|
| Phosphoric Acid to adjust pH to | 4.1–4.2 |

Example VI

| | |
|---|---|
| Potassium Ferrocyanide ($K_4Fe(CN)_6 . 3H_2O$ | 5.0 |
| Monobasic ammonium Phosphate $NH_4H_2PO_4$ | 5.0 |
| Glycerine | 8.0 |
| Tris-hydroxymethyl-aminomethane | 4.0 |
| Gum Arabic | 0.5 |
| Distilled Water | 78.5 |
| Phosphoric Acid to adjust pH to | 4.1–4.2 |

In each of the examples, other ingredients may optionally be included in order to give certain improvements to the conversion solutions. One of the problems of ferrocyanide solutions is that they decompose rather rapidly especially when allowed to be exposed to air in a developer tray for several days. The reason for instability is the effect of air and light resulting in chemical changes in the concentration of active iron and in the general appearance of exposed solutions. Light and air accelerate decomposition and oxidation of ferrocyanide ion to ferricyanide or ferric ion, both of which give the recognized blue color with ferrocyanide. The decomposition products are ineffective in carrying out that conversion reaction. Hence, it is desirable to add stabilizing ingredients known from the prior art such as a soluble sulfite salt disclosed in Netherlands Patent Application No. 6803164 opened to inspection on May 27, 1968 and assigned to Agfa Gevaert NV, Mortseo, Belgium. The range over which the amount of sulphite salt provides the proper stabilizing effect is from 0.25 to 2.5 percent by weight of the conversion solution.

Another ingredient which optionally may be included in the formulation are chelating agents which are employed in the composition for the purpose of forming a complex with the ferrous or ferric ions which are formed by reason of the dissociation of the ferrocyanide and thereby prevents further precipitation of the active ingredients in the conversion solution. The treatment of photographic plates in the field of color photography utilizes an ester derivative of an amino carboxylic acid, namely ethylene diamine tetra-acetic acid. Such treatments are described in U.S. Pat. No. 3,256,092 granted to Paul B. Means on June 14, 1966. The chelating agents may be employed to advantage in amounts ranging from 1 to 6 weight percent of the conversion solution.

The general method whereby the solutions of this invention are utilized requires the preparation of a master by electrostatic reproduction techniques. The photoconductive member is first applied a blanket electrostatic charge of the appropriate polarity and then exposed to a pattern of light and shadow to create a charge pattern on the photoconductive layers. The charge pattern is developed into a material image by the application of a resinous electroscopic powder. The electroscopic powder is fused onto the surface of the master. The oleophilic character of the resins that make up the powder image render it suitable to accept the oil based inks used in the printing operation. The nonimage areas are converted to hydrophilicity by applying the conversion solutions described in detail hereinabove.

Having described the formulations and operation of the invention in detail in order to enable one of ordinary skill in the art to practice the invention, certain modifications as to the amounts of their ingredients and/or chemical equivalents are deemed to come within the objects of the invention.

What is claimed is:

1. A conversion solution for treating an imaged electrostatic planographic master comprising a photoconductive material carried in a resinous binder to convert the non-image hydrophobic portions of said master to a condition of hydrophilicity comprising an aqueous solution of potassium ferrocyanide, a mineral acid, a buffering salt selected from the group consisting of monobasic ammonium phosphate and monobasic sodium phosphate to mantain the PH in the range from about 4.0 to about 5.0 and a solubilizing amine present in an amount from 1.0 - 6.0 weight percent having the formula:

$$R\,R'\,N - C_nH_{2n} - O - X$$

wherein R and R' are the same or different alkyl or hydroxy alkyl or amine alkyl substituents or hydrogen, X is hydrogen, lower alkyl or lower hydroxy alkyl and *n* is an integer from 2 to 4, inclusive.

2. The conversion solution as claimed in claim 1 wherein the amine is triethanolamine.

3. The conversion solution as claimed in claim 1 wherein the amine is diethanolamine.

4. The conversion solution as claimed in claim 1 wherein the amine is monoethanolamine.

5. The conversion solution as claimed in claim 1 wherein the amine is 2-amino-2-methyl-1,3-proponediol.

6. The conversion solution as claimed in claim 1 wherein the weight percent of ferrocyanide is in the range of 0.5 to 5.0 percent of said solution.

7. A conversion solution for treating an imaged electrostatic planographic master comprising a photoconductive material comprising zinc oxide dispersed in a resin binder and applied to a base support to convert the non-imaged hydrophobic portions of said master to a condition of hydrophilicity comprising an aqueous solution of potassium ferrocyanide, phosphoric acid and monobasic sodium phosphate to maintain the PH in the range from about 4.0 to about 5.0 and a solubilizing amine present in an amount from 1.0 - 6.0 weight percent having the formula:

$$R\,R'\,N - C_nH_{2n} - O - X$$

where R and R' are the same or different alkyl or hydroxy alkyl or amino alkyl substituents or hydrogen, X is hydrogen, lower alkyl or lower hydroxy alkyl and *n* is an integer from 2 to 4, inclusive.

8. The method of converting a planographic master from a photoconductive member comprising the steps of charging the photoconductive layer, casting a pattern of light and shadow onto the charged surface creating a charge pattern thereon, developing said charge pattern into a material image by applying an oleophilic electroscopic powder, fusing the material image and applying a conversion solution comprising an aqueous solution of potassium ferrocyanide, a mineral acid, a buffering salt selected from the group consisting of monobasic ammonium phosphate and monobasic sodium phosphate to maintain the PH in the range from about 4.0 to about 5.0 and a solubilizing amine present in an amount from 1.0–6.0 weight percent having the formula $$R\,R'\,N - C_nH_{2n} - O - X$$

wherein R and R' are the same or different alkyl or hydroxy alkyl or amino alkyl substituents or hydrogen, X is hydrogen, lower alkyl or lower hydroxy alkyl and *n* is an integer from 2 to 4, inclusive, and converting said non-image areas on said photoconductive member to a condition of hydrophilicity whereby said surface is differentially receptive to oil based inks and water.

9. The method as set forth in claim 8 wherein said amine is triethanol amine.

10. The method as set forth in claim 8 wherein said amine is diethanolamine.

11. The method as set forth in claim 8 wherein the amine is monoethanolamine.

12. The method as set forth in claim 9 wherein the amine is 2-amino-2-methyl-1,3,-propanediol.

* * * * *